US009249985B2

(12) United States Patent
Cursetjee et al.

(10) Patent No.: US 9,249,985 B2
(45) Date of Patent: Feb. 2, 2016

(54) ADJUSTABLE EQUIPMENT MOUNT ASSEMBLY FOR AN OVERHEAD SUPPORT MODULE

(71) Applicant: Huntair, Inc., Tualatin, OR (US)

(72) Inventors: Zareer Cursetjee, Happy Valley, OR (US); Kevin Schreiber, Happy Valley, OR (US); David L. Baugh, Newberg, OR (US)

(73) Assignee: Nortek Air Solutions, LLC, Eden Prairie, MN (US)

( * ) Notice: Subject to any disclaimer, the term of this patent is extended or adjusted under 35 U.S.C. 154(b) by 235 days.

(21) Appl. No.: 13/737,197

(22) Filed: Jan. 9, 2013

(65) Prior Publication Data

US 2014/0191100 A1 Jul. 10, 2014

(51) Int. Cl.

| | |
|---|---|
| ***F24F 7/00*** | (2006.01) |
| ***F24F 13/32*** | (2006.01) |
| ***F24F 13/28*** | (2006.01) |
| ***F24F 13/06*** | (2006.01) |

(52) U.S. Cl.

CPC ..... *F24F 13/32* (2013.01); *F24F 13/06* (2013.01); *F24F 13/28* (2013.01); *F24F 2221/14* (2013.01)

(58) Field of Classification Search

CPC ..... F24F 13/32; F24F 2221/14; F24F 13/06; F24F 13/28; F24F 7/007

USPC ..... 248/317, 327; 454/187, 292

See application file for complete search history.

(56) References Cited

U.S. PATENT DOCUMENTS

| | | | | |
|---|---|---|---|---|
| 4,406,216 | A * | 9/1983 | Hott | F24F 7/013 248/343 |
| H297 | H | 7/1987 | Schultz | |
| 5,029,518 | A | 7/1991 | Austin | |
| 5,279,632 | A | 1/1994 | Decker | |
| 5,512,017 | A | 4/1996 | Gore | |
| 5,911,661 | A | 6/1999 | Murray | |

(Continued)

FOREIGN PATENT DOCUMENTS

| | | | |
|---|---|---|---|
| JP | 08-005103 | A | 1/1996 |
| JP | 09-264567 | A | 10/1997 |

(Continued)

OTHER PUBLICATIONS

"International Application Serial No. PCT/US2014/010723, International Search Report mailed Apr. 14, 2014", 3 pgs.

(Continued)

*Primary Examiner* — Todd M Epps

(74) *Attorney, Agent, or Firm* — Schwegman Lundberg & Woessner, P.A.

(57) ABSTRACT

An adjustable equipment mount assembly is configured to be adjustably secured within an overhead support module that is configured to be secured to a structure, such as a ceiling of an enclosed room. The overhead support module is configured to deliver air to the structure. The assembly may include an equipment mounting plate configured to connect to equipment, one or more first adjustable support members configured to allow the equipment mounting plate to be adjusted between different positions with respect to the overhead support module in a first direction, and one or more second adjustable support members configured to allow the equipment mounting plate to be adjusted between different positions with respect to the overhead support module in a second direction that differs from the first direction.

21 Claims, 5 Drawing Sheets

(56) References Cited

U.S. PATENT DOCUMENTS

| | | | | |
|---|---|---|---|---|
| 2011/0097986 | A1* | 4/2011 | Cursetjee | F24F 13/32 454/187 |
| 2012/0077429 | A1 | 3/2012 | Wernimont | |
| 2014/0170958 | A1* | 6/2014 | Cursetjee | F24F 13/28 454/292 |
| 2014/0355248 | A1* | 12/2014 | Cursetjee | F24F 13/078 362/96 |

FOREIGN PATENT DOCUMENTS

| | | | |
|---|---|---|---|
| KR | 10-2012-0047018 | A | 5/2012 |
| WO | WO-2014110162 | A1 | 7/2014 |

OTHER PUBLICATIONS

"International Application Serial No. PCT/US2014/010723, Written Opinion mailed Apr. 14, 2014", 8 pgs.

"International Application Serial No. PCT/US2014/010723, International Preliminary Report on Patentability mailed Jul. 23, 2015", 10 pgs.

Kang, Dong Won, "A Heat Exchanger", Translation of Korean Application No. KR20100108641 20101103 with Translation Certification, (May 11, 2012), 26 pgs.

* cited by examiner

ADJUSTABLE EQUIPMENT MOUNT ASSEMBLY FOR AN OVERHEAD SUPPORT MODULE

BACKGROUND OF THE DISCLOSURE

Embodiments of the present disclosure generally relate to an adjustable equipment mount assembly configured for use with an overhead support module that extends below a ceiling of a structure.

Certain interior environments, such as clean rooms, hospital-like operating rooms, radiology rooms, and dental suites, utilize extremely clean air in order to protect target sites and work therein. Electronic equipment may generate heat. As such, systems may be used that concentrate cool air within the vicinity of the heat-generating equipment. Individuals, such as surgeons, may also prefer to have available additional heated or cooled air in the immediate vicinity of an operating table, to hold a patient at a stable temperature or dissipate the excess heat created by bright lamps or a team of doctors and nurses surrounding the patient. However, the needs of a given room may change over time, as new technology replaces what was originally installed, or the room is converted to different uses and configurations. Accordingly, it may be undesirable to have air conditioning and ventilation permanently installed as part of the structure of the building. Additionally, when multiple parties provide equipment for the internal spaces, there is typically significant coordination required during the design and construction phase to avoid scheduling and product conflicts. Therefore, modular systems that may be installed or removed with only minor structural alterations may be preferred and utilized.

Modular installation systems typically result in construction that is less expensive and more convenient. For example, ventilation structures need not be custom fabricated on-site, nor incorporated into the structure during construction. Instead, modular units may be mass-produced at an off-site factory and shipped to a location during construction. On-site fabrication may then be limited to fabrication and alterations as are necessary to attach the modular units to the frame of the building.

In modern operating rooms, equipment such as robotic surgical aids may be used. The surgical aids typically make surgery more precise and less prone to errors caused by the inherent fallibility of human hands. Additionally, even in typical clean environments, there may be a significant need for overhead-supported equipment, such as light boom assemblies, automated material handling systems, and the like. Typically, such equipment is hung from the building structure and descends through the ceiling in order to preserve valuable floor space. However, the arrangement may be expensive, require a custom installation during building construction, and may limit the possible room configurations based on the nature of the underlying building frame.

Additionally, equipment that is hung from a building structure is typically fixed in place. For example, an equipment boom may be secured to a stationary equipment mount within a building structure. Accordingly, if the configuration of a room is later changed, a new equipment mount may need to be installed in the room, and the previous equipment mount removed, in order to accommodate the new configuration. As can be appreciated, however, adding and removing equipment mounts may be costly and time-consuming.

SUMMARY OF THE DISCLOSURE

Certain embodiments of the present disclosure provide an adjustable equipment mount assembly configured to be adjustably secured within an overhead support module that is configured to be secured to a ceiling of an enclosed structure. The overhead support module is configured to deliver conditioned air to the enclosed structure. The adjustable equipment mount assembly may include an equipment mounting plate configured to connect to equipment, one or more first adjustable support members configured to allow the equipment mounting plate to be adjusted between different positions with respect to the overhead support module in a first direction, and one or more second adjustable support members configured to allow the equipment mounting plate to be adjusted between different positions with respect to the overhead support module in a second direction that differs from the first direction. The first direction may be orthogonal to the second direction.

The assembly may also include an extension member extending from the equipment mounting plate. The extension member may include a securing plate configured to securely mount to the equipment. The extension member may be removably secured to the equipment mounting plate. In at least one embodiment, a height of the extension member is configured to be adjusted.

The assembly may include one or more mounting beams connected to the equipment mounting plate and the first adjustable support member(s). One or both of the first adjustable support member(s) and the second adjustable support member(s) may include a securing wall integrally connected to a ledge. A fastener may be configured to be adjustably retained within the ledge. In at least one other embodiment, one or both of the first adjustable support member(s) and the second adjustable support member(s) may include an adjustable guide beam configured to adjustably retain a portion of a fastener. In one or more embodiments, one or both of the first adjustable support member(s) and the second adjustable support member(s) may include an adjustable clamp. In one or more embodiments, one or both of the one first adjustable support member(s) and the second adjustable support member(s) may include one or more wheels operatively connected to a brake.

Certain embodiments of the present disclosure provide an overhead support module configured to modularly secure to a ceiling of a structure. The overhead support module may include outer walls defining an internal chamber, guide rails inwardly extending into the internal chamber from one or more of the outer walls, and an adjustable equipment mount assembly adjustably secured to internal portions of the outer walls within the internal chamber. The adjustable equipment mount assembly may include an equipment mounting plate configured to connect to equipment, first adjustable support members adjustably secured to the guide rails, and second adjustable support members adjustably secured with respect to the equipment mounting plate. The first adjustable support members may be configured to be adjusted with respect to the guide rails to allow the equipment mounting plate to be adjusted with respect to the overhead support module in a first direction. The second adjustable support members may be configured to be adjusted with respect to the equipment mounting plate to allow the equipment mounting plate to be adjusted with respect to the overhead support module in a second direction that differs from the first direction.

BRIEF DESCRIPTION OF THE DRAWINGS

FIG. 3 illustrates an end view of an adjustment guide beam, according to an embodiment of the present disclosure.

FIG. 4 illustrates a front view of a support mounting beam secured to a guide rail, according to an embodiment of the present disclosure.

Figure 1:
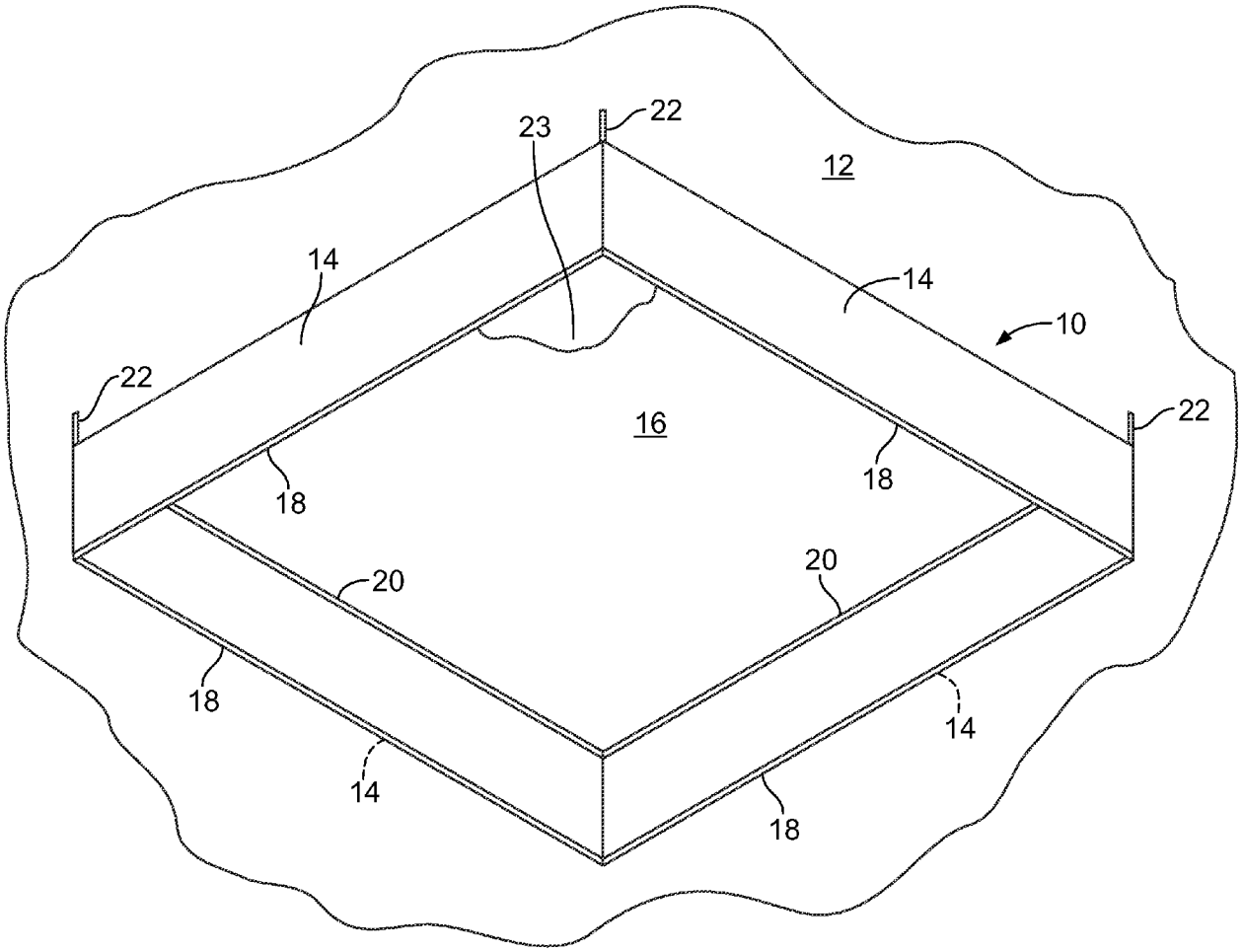
FIG. 1 illustrates an isometric bottom view of an overhead support module, according to an embodiment of the present disclosure.

Before the embodiments are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DRAWINGS

FIG. 1 illustrates an isometric bottom view of an overhead support module 10, according to an embodiment of the present disclosure. The overhead support module 10 may be a plenum box module, or other such system that is configured to modularly secure to a ceiling 12 of a structure. The support module 10 may be configured to support an air handling unit, sprinkler systems, lighting systems, equipment, and the like. The support module 10 is further described in U.S. Patent Application Publication No. 2011/0097986, entitled "Ceiling System With Integrated Equipment Support Structure," which is hereby incorporated by reference in its entirety. The overhead support module 10 is configured to be secured to a ceiling of an enclosed structure, such as clean room. As such, the overhead support module 10 is configured to be positioned over individuals within the enclosed structure. The overhead support module 10 defines an internal air delivery chamber that is in fluid communication with an air delivery system, such as an air handling unit. Conditioned air from the air handling unit is passed to the air delivery chamber, and into the enclosed structure through one or more air delivery outlets formed in the overhead support module 10. Thus, the overhead support module is configured to deliver conditioned air to the enclosed structure.

The overhead support module 10 may form a plenum that includes outer walls 14 that define an internal chamber 16. The outer walls 14 may connect together at right angles, and form a generally square or rectangular structure, as shown. However, the outer walls 14 may be various other shapes and sizes, such as circular, elliptical, triangular, trapezoidal, or the like.

The outer walls 14 may be formed of metal, such as sheet steel, for example. However, the outer walls may be formed of various other materials, such as reinforced plastic. In general, the outer walls 14 are configured to accommodate heating and cooling needs of the structure, as well as to securely attach to the ceiling 12. Each of the outer walls 14 may include a lower lip 18 and a support beam 20, which may be located at upper portions of the outer walls 14. The upper support beam 20 may be formed as a rectangular member, such as a rectangular beam, tube, or the like.

While not shown in FIG. 1, grid members may be attached to the lower lip 18, and form a grid of supports for the ordinary parts of a suspended ceiling, such as ceiling tiles, lights, and vents for air passage (not shown). Alternatively, grid members may be attached to other portions of the outer walls 14. The grid members may be formed as rectangular tubes or U-shaped channels of stainless steel, or extruded aluminum, but may be constructed of other materials and in other shapes as well. The grid members are rigid in order to span the overhead support module 10 without additional support. The grid members may also be attached to the building structure, for instance by the use of hangers, for greater load-bearing capacity. Alternatively, the overhead support module 10 may not include grid members, but may, instead, simply include the outer walls 14, as shown.

A clean room barrier 23 may form a suspended ceiling and extend from the outer walls 14 proximate the lower lip 18 of the overhead support module 10. In order to clearly show the structure of the overhead support module 10, only a portion of the clean room barrier 23 is shown in FIG. 1. The clean room barrier 23 separates the internal chamber 16 from a clean room into which the overhead support module 10 is secured. The internal chamber 16 may provide an air delivery chamber that is configured to convey air, such as air conditioned by an air handling system, to the internal space of the clean room. For example, the internal chamber 16 may be in communication with an output of an air handling unit that is configured to provide conditioned air to the clean room. An air outlet may be secured to or formed through a portion of the clean room barrier 23 to allow conditioned air to pass from the overhead support module 10 into the clean room.

The overhead support module 10 may be sealed at the top by a sealing wall or roof in order to control airflow. The sealing wall or roof may be formed of sheet metal, plastic, or the like. A hole may be formed in the sealing wall and/or the outer walls 14 to permit air to enter or leave the overhead support module 10, and therefore the room. An air handling component (not shown) may be mounted adjacent the hole(s), or may be operatively connected to a duct (not shown) that connects to the hole(s). Alternatively, the overhead support module 10 may have an air handling component mounted directly thereto. The overhead support module 10 may receive supply air from various types of HVAC and air handling systems.

The overhead support module 10 may be suspended from the ceiling 12 by hangers 22, which may in turn attach directly to I-beams or other frame members of the building. The hangers 22 may also be attached to a secondary structure (not shown) which in turn attaches to the frame of the building. Alternatively, the overhead support module 10 may also be bolted directly to part of the building or an adapter rather than suspended from hangers 22. As shown in FIG. 1, the hangers 22 may be at the corners of overhead support module 10, but may be placed in other locations, or with greater spatial frequency than shown.

Figure 2:
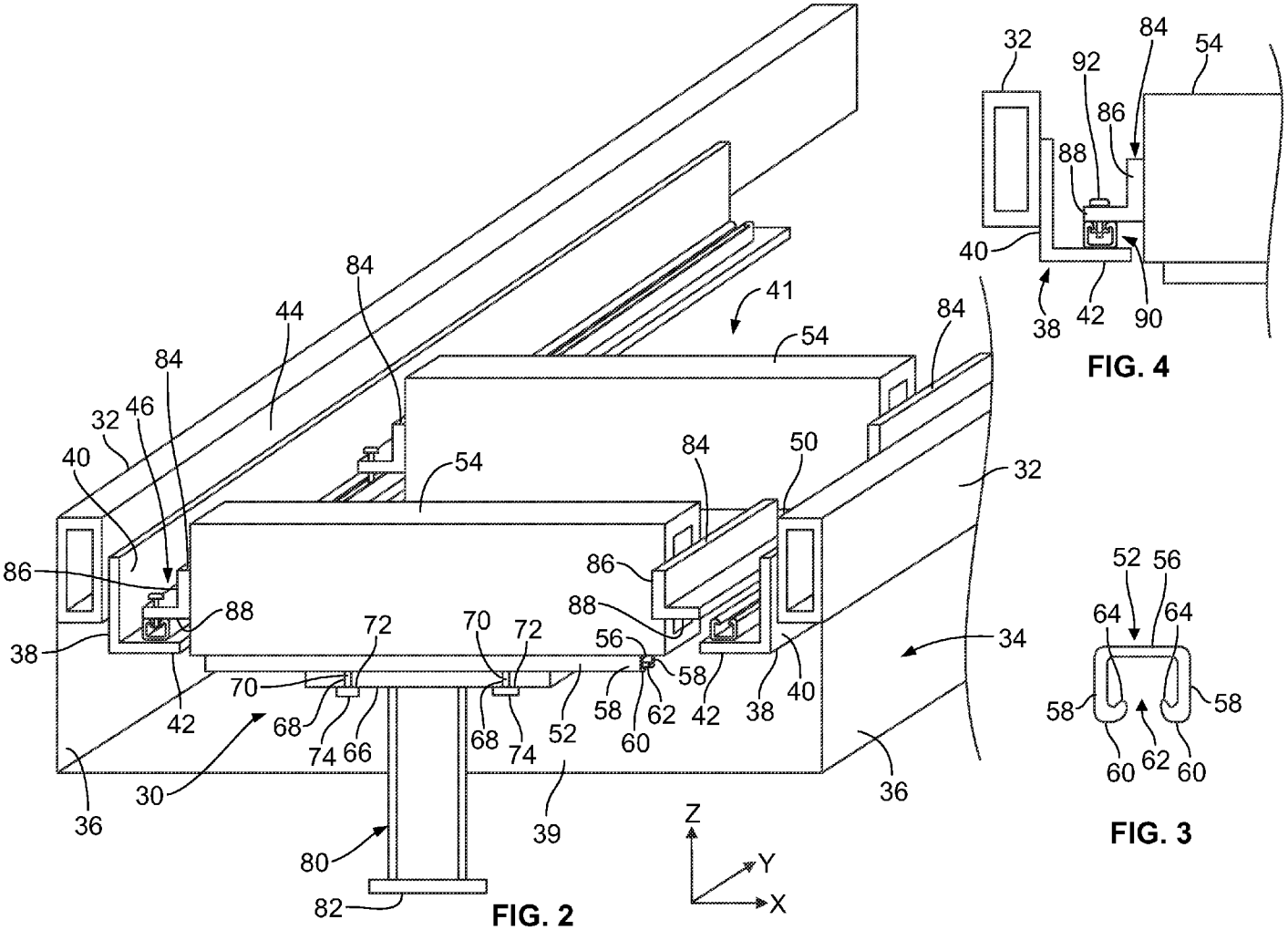
FIG. 2 illustrates an isometric front view of an adjustable equipment mount assembly secured to beams of an overhead support module, according to an embodiment of the present disclosure.

FIG. 2 illustrates an isometric front view of an adjustable equipment mount assembly 30 secured to support beams 32 of an overhead support module 34, such as a plenum box module, according to an embodiment of the present disclosure. The overhead support module 34 may be similar to the overhead support module 10 shown in FIG. 1. The overhead support module 34 is suspended from a ceiling of a structure, such as described with respect to FIG. 1. As explained below, the adjustable equipment mount assembly 30 is configured to be adjusted, such as through slideable translation, or other such movement, in various directions so that the adjustable equipment mount assembly 30 may be moved between various positions with respect to the overhead support module 34. For example, the adjustable equipment mount assembly 30 is configured to be linearly adjusted with respect to the overhead support module 34 in lateral and longitudinal directions that are aligned with the X- and Y-axes. Additionally, at least a portion of the adjustable equipment mount assembly 30 is configured to be adjusted in directions that are aligned with the Z-axis. Optionally, the adjustable equipment mount assembly 30 may be rotationally adjusted with respect to X-, Y-, and/or Z-axes.

The overhead support module 34 may be similar to the overhead support module 10 shown in FIG. 1, and include outer walls 36 having the support beams 32. In order to show the adjustable equipment mount assembly 30, not all the outer walls 36 are shown. The support beams 32 may be formed as rectangular beams, tubes, or the like. However, the support beams 32 may be formed in various other shapes and sizes, and may or may not be tubular. The adjustable equipment mount assembly 30 is adjustably secured between opposed support beams 32.

A clean room barrier 39 may extend between the outer walls 36 proximate lower edges. The clean room barrier 39 may be or include one or more panels that provide a ceiling-like structure at a lower portion of the overhead support module 34.

Guide rails 38 may be secured to the opposed support beams 32. Each guide rail 38 may include a flat, planar securing wall 40 integrally formed with a flat, planar guide track 42. The securing wall 40 and the guide track 42 may be perpendicularly oriented with respect to one another. The securing wall 40 is secured to an inwardly-directed outer surface 44 of the beam 32. The securing wall 40 may be secured to the outer surface 44 of the beam 32 through various fasteners, adhesives, welding, and/or the like. For example, the securing wall 40 may be welded to the outer surface of the beam 32. Optionally, each beam 32 may be formed to include an integral guide rail 38. An assembly track adjustment area 46 is defined between the wall 40 and track 42, and is configured to allow adjustment guide beams 90 of the adjustable equipment mount assembly 30 to be adjusted therethrough, such as through slideable translation.

The equipment mount assembly 30 includes a base 50 that may include or connect to adjustable support members, such as adjustment guide beams 52, at front and rear edges. The base 50 may be a flat, planar sheet that supports longitudinal mounting beams 54. The mounting beams 54 may be rectangular structures, such as tubes or solid beams, similar to the support beams 32. The mounting beams 54 may be positioned over the adjustment guide beams 52. The base 50 may be integrally formed with the adjustment guide beams 52 and the mounting beams 54. Optionally, the base 50 may be integrally molded and formed with the adjustment guide beams 52 and the mounting beams 54 as a single piece of material, such as metal or plastic. The adjustment guide beams 52 provide adjustable support members that allow the equipment mount assembly 30 to be laterally adjusted with respect to the overhead support assembly in directions that are aligned with the X-axis.

FIG. 3 illustrates an end view of an adjustment guide beam 52, according to an embodiment of the present disclosure. Referring to FIGS. 2 and 3, each adjustment guide beam 52 may include a closed base 56 integrally connected to side walls 58, which, in turn, connect to folded ends 60 that define a gap 62 therebetween. The closed base 56 may be perpendicular to the side walls 58. Further, the closed base 56 may be parallel to the folded ends 60. The gap 62 is configured to allow a shaft of a fastener, such as a screw, to pass therein. However, the diameter of the head of the fastener is greater than the gap 62. Accordingly, an underside of the head of the fastener is configured to be supported by upper surfaces 64 of the folded ends 60.

Referring again to FIG. 2, a planar mounting plate 66 may be adjustably secured to one or more of the adjustment guide beams 52. Optionally, the mounting plate 66 may be an integral part of the base 50. While FIG. 2 shows one adjustment guide beam 52, with the other being hidden from view, three or more adjustment guide beams 52 may be secured underneath the base 50.

The mounting plate 66 may include fastener through holes 68 that are configured to receive shafts 70 of fasteners 72, such as bolts. Each fastener 72 may include a head 74 integrally connected to the shaft 70. A securing nut (hidden from view) is secured to a distal end of the shaft 70 and is positioned within and supported by the adjustment guide beam 52. Optionally, the head of each fastener 72 may be positioned within the adjustment guide beam 52, while the securing nut is positioned below the mounting plate 66. The mounting plate 66 is secured to the base 50 through the fasteners 72 being secured within the adjustment guide beams 52. The mounting plate 66 may be adjusted with respect to the base 50 by loosening fasteners 72, and adjusting, through slideable translation, for example, the mounting plate 66 over directions aligned with the X-axis. The fasteners 72 are adjustably positioned with respect to the mounting plate 66 and the adjustment guide beam 52 in order to allow the mounting plate 66 to be adjustably positioned with respect to the adjustment guide beam 52. When the mounting plate 66 is positioned at a desired location, the fasteners 72 are tightened, thereby securing the mounting plate to the adjustment guide beam(s) 52, and securing the mounting plate 66 in place.

As shown, an extension member 80, such as a tube, beam, column, post, or the like, may extend downwardly from the mounting plate 66. The extension member 80 may be sized and shaped to extend below a lower surface of the outer walls 36, in order to position equipment below ceiling tiles, or the like. The extension member 80 may include a distal securing plate 82, configured to secure to equipment, such as a boom assembly, medical monitor, or the like. Alternatively, the adjustable equipment mount assembly 30 may not include the extension member 80, but may, instead, simply include the mounting plate 66, which may be configured to securely retain a piece of equipment.

The extension member 80 may be integrally molded and formed with the mounting plate 66. Optionally, the extension member 80 may be secured to the mounting plate 66 through fasteners, such as bolts, screws, or the like. As such, the extension member 80 may be removed from the mounting plate 66, and replaced with a different extension member, which may be sized and shaped different than the extension member 80 shown.

As shown in FIG. 2, the extension member 80 extends below the clean room barrier 39. The clean room barrier 39 may include panels having sealed passages configured to sealingly engage an outer portion of the extension member 80. Accordingly, the clean room barrier 39 may separate an internal chamber 41 of the overhead support module 34 from a clean room or operating room, for example. The equipment mount assembly 30 is configured to be selectively positioned within the internal chamber 41, such as an air delivery chamber, of the overhead support module, such that the extension member 80 may be moved with respect to the clean room barrier 39. In order to move the equipment mount assembly 30, one or more portions of the clean room barrier 39 may be removed so that the equipment mount assembly 30 may be selectively repositioned with respect to the internal chamber 41 of the overhead support module 34. Once repositioned, the one or more portions of the clean room barrier 39 are re-secured to the overhead support module 34 in order to separate the internal chamber 41, such as an air delivery chamber, of the overhead support module 34 from an enclosed structure, such as a clean room or operating room. As such, at least a portion of the equipment mount assembly 30 is positioned within the internal chamber 41 of the overhead support module 34. However, the equipment mount assembly 30 may or may not be in fluid communication with conditioned air that is to be delivered through the overhead support module 34 to the enclosed structure.

FIG. 4 illustrates a front view of a support mounting beam 54 secured to a guide rail 38, according to an embodiment of the present disclosure. Referring to FIGS. 2 and 4, adjustable support members 84 are secured to ends of the mounting beams 54. Each adjustable support member 84 may include a flat, planar securing wall 86 integrally connected to a perpendicular planar ledge 88. The walls 86 are secured to ends of the mounting beams 54, such as through fasteners, adhesives, welding, and/or the like. The adjustable support members 84 are configured to allow the adjustable equipment mount assembly 30 to be longitudinally adjusted with respect to the overhead support module 34 in directions that are aligned with the Y-axis.

An adjustment guide beam 90, similar to the adjustment guide beam 52 (shown in FIGS. 2 and 3, is secured above the track 42 of the guide rail 38. The adjustment guide beam 90 is configured to adjustably retain one or more fasteners 92, in a similar fashion as described with respect to the adjustment guide beam 52.

As shown in FIG. 2, a separate and distinct adjustable support member 84 may be secured to each end of the support mounting beams 54. Optionally, a single adjustable support member 84 may span between support mounting beams 54 that are supported by a common guide rail 38. Thus, instead of four adjustable support members 84, as shown in FIG. 2, the adjustable equipment mount assembly 30 may include two adjustable support members 84.

The adjustable support members 84 support the adjustable equipment mount assembly 30 with respect to the opposed guide rails 38. In order to adjust or otherwise move the adjustable equipment mount assembly 30 in directions aligned with the Y axis, the fasteners 92 may be loosened, so that the fasteners 92, and therefore the adjustable support members 84, may be slid through the adjustment guide beams 90. When the adjustable equipment mount assembly 30 is moved to a desired location, the fasteners 92 may be re-engaged to tighten the fasteners 92 with respect to the adjustment guide beams 90, in order to securely lock the adjustable equipment mount assembly 30 at a desired position with respect to the Y axis.

Thus, the adjustable equipment mount assembly 30 may be adjusted with respect to the Y-axis by sliding the adjustable support members 84 over the guide rails 38 in directions aligned with the Y-axis. Further, the mounting plate 66 may be adjusted with respect to the adjustment guide beams 52 in directions aligned with the X-axis, which is orthogonal to the Y-axis. Accordingly, equipment secured to the adjustable equipment mount assembly 30 may be adjusted with respect to the overhead support module 34 in first directions and second directions that are orthogonal to the first directions. Further, the extension member 80 may be interchangeable with other extension members to provide adjustability in directions that are aligned with the Z-axis. As shown in FIG. 2, equipment secured to the equipment mount assembly 30 may be adjusted laterally in directions aligned with the X-axis, longitudinally in directions aligned with the Y-axis, and vertically in directions aligned with the Z-axis. Therefore, the equipment mount assembly 30 allows for quick and easy adjustment and adaptation of equipment with respect to the overhead support module 34.

Figure 5:
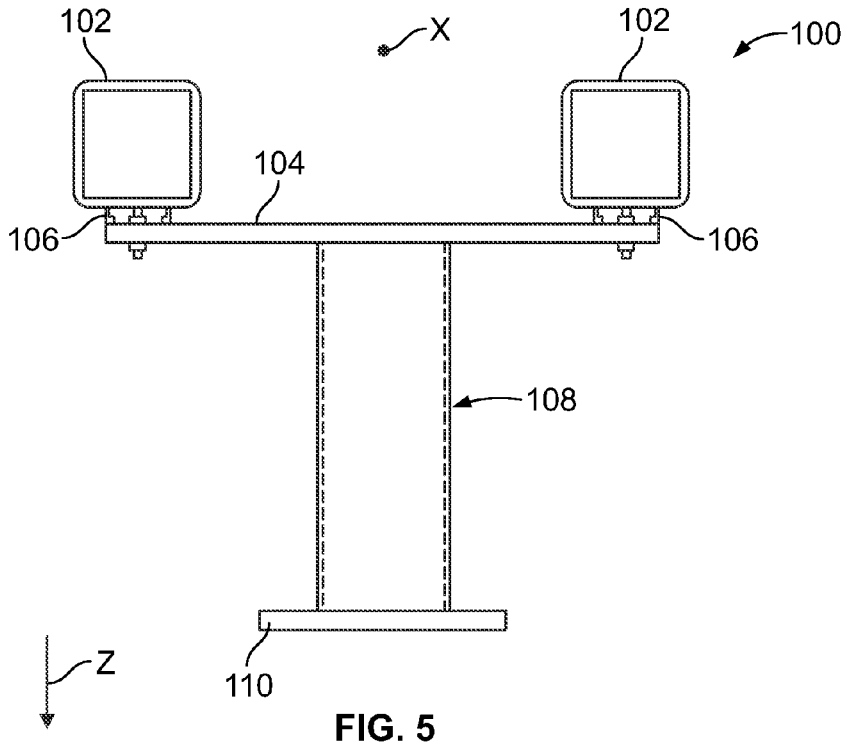
FIG. 5 illustrates a lateral view of an adjustable equipment mount assembly, according to an embodiment of the present disclosure.

FIG. 5 illustrates a lateral view of an adjustable equipment mount assembly 100, according to an embodiment of the present disclosure. As shown in FIG. 5, longitudinal mounting beams 102, such as the mounting beams 54, may be secured to a base 104, such as the base 50, through adjustable support members, such as adjustable guide beams 106, which may be similar to the adjustable guide beams 52. As shown in FIG. 5, instead of using a separate and distinct mounting plate, the base 104 may be or may include a mounting plate that securely retains an extension member 108 having a distal securing plate 110.

Optionally, instead of the adjustable guide beams 106 being securely fixed to the mounting beams 54, the adjustable guide beams 106 may be securely fixed to the base 104, such as through fasteners, adhesives, welding, and/or the like. In this embodiment, the mounting beams 54 may be adjustably secured to the adjustable guide beams 106 in directions that are aligned with the X-axis.

Figure 6:
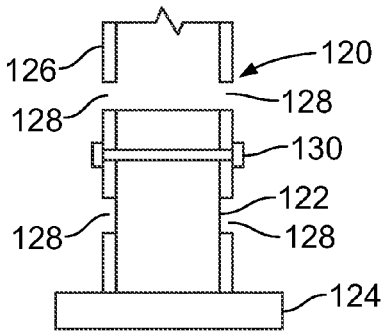
FIG. 6 illustrates a cross-sectional view of an extension member, according to an embodiment of the present disclosure.

FIG. 6 illustrates a cross-sectional view of an extension member 120, according to an embodiment of the present disclosure. As discussed above, the extension member 120 may be removed and replaced from the base of an adjustable equipment mount assembly in order to provide adjustability in directions aligned with the Z-axis. As such, the extension member 120 may be interchangeable with other extension members.

Additionally, the extension member 120 may include an inner member 122, such as a tube, beam, or the like, having a securing plate 124 secured to a distal end. The inner member 122 is configured to be received and adjustably retained within an outer member 126, such as a tube, beam, or the like, having a plurality of passages 128 formed therethrough. The inner member 122 may include a securing pin 130 that may be retained within opposed passages 128. The securing pin 130 may be removed in order to allow the inner member 122 to be adjusted with respect to the outer member 126. At a desired location, the securing pin 130 may be re-inserted in order to secure the inner member 122 with respect to the outer member 126. Accordingly, the extension member 120 may be adjusted with respect to the Z-axis without being removed from an adjustable equipment mount assembly, such as any of the assemblies 30 and 100 discussed above.

The securing pin 130 may be a spring-biased clip that may be engaged in order to remove the securing pin 130 from the passages 128. After engagement, the securing pin 130 may resiliently expand back to an at-rest position in which the securing pin 130 is unable to slide through the passages 128. Also, alternatively, the securing pin 130 may simply be a fastener, such as a bolt, and securing nut. Additional securing pins 130 may be used to secure the inner member 122 with respect to the outer member 126.

Figure 7:
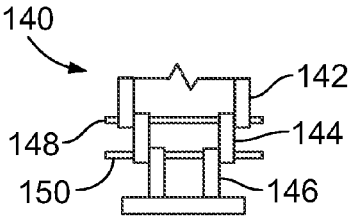
FIG. 7 illustrates a cross-sectional view of an extension member, according to an embodiment of the present disclosure.

FIG. 7 illustrates a cross-sectional view of an extension member 140, according to an embodiment of the present disclosure. In this embodiment, the extension member 140 may include telescoping segments 142, 144, and 146 that may telescope with respect to one another. The telescoping segments 142, 144, and 146 may be locked in place through securing pins 148 and 150, as described above. In order to adjust the length of the extension member 140, the securing pins 148 and 150 may be removed, in order to allow the extension member 140 to telescope inwardly or outwardly. When the desired length is reached, the securing pins 148 and 150 may be re-inserted, in order to secure the extension member 140 in position. The extension member 140 may include more or less telescoping segments and securing pins than shown.

Figure 8:
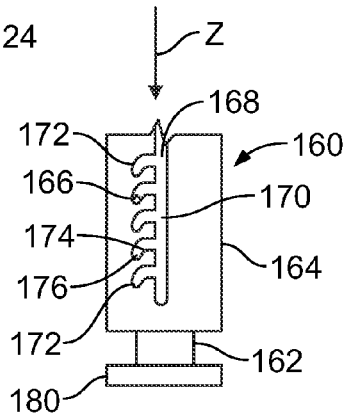
FIG. 8 illustrates a lateral view of an extension member, according to an embodiment of the present disclosure.

FIG. 8 illustrates a lateral view of an extension member 160, according to an embodiment of the present disclosure. The extension member 160 may include an inner member 162 adjustably positioned within an outer member 164. The inner member 162 may include one or more securing pins 166 extending from an outer surface. The securing pin(s) 166 may be permanently fixed and stationary with respect to the inner member 162. For example, the securing pin(s) 166 may be posts, studs, beams, or the like outwardly extending from the inner member 162. The securing pin(s) 166 is disposed within an adjustment channel 168 formed through the outer member 164. The adjustment channel 168 may include a main vertical path 170 having a plurality of adjustment branches 172 extending therefrom. Each adjustment branch 172 may include an upwardly curved passage 174 connected to a lower retaining area 176.

In order to adjust the height of a securing plate 180, the inner member 162 is manipulated in order to move the securing pin(s) 166 out of the lower retaining area 176, through the curved passage 174, and into the main vertical path 170. The inner member 162 may then be moved in directions aligned with the Z-axis such that the securing pin(s) 166 slides through the main vertical path 170. At a desired height, the inner member 162 is manipulated so that the securing pin(s) 166 is securely retained within a lower retaining area 176. Accordingly, the securing plate 180 may be adjusted relative to the Z-axis.

Referring to FIGS. 6-8, any of the extension members may be used in place of the extension member 80 of FIG. 2. As described, the extension members may be manually adjusted to different lengths. The height of each extension member may be adjusted, as described above. Alternatively, the extension members may be operatively connected to an actuating device, such as a motor, in order to automatically adjust and control the height of the extension members.

Figure 9:
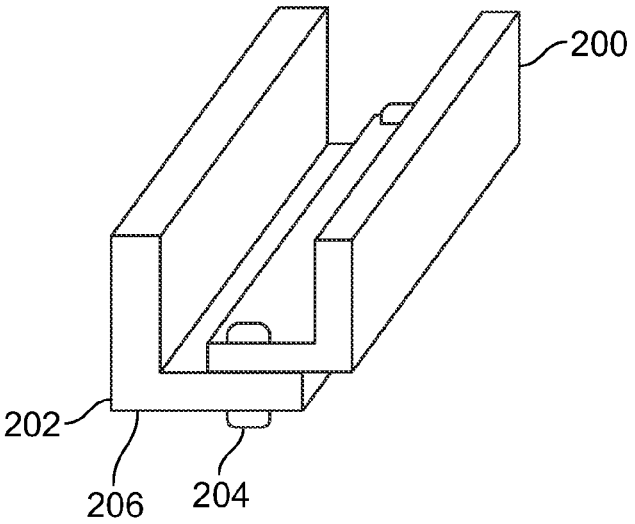
FIG. 9 illustrates an isometric top view of an adjustable support member secured to a guide rail, according to an embodiment of the present disclosure.

FIG. 9 illustrates an isometric top view of an adjustable support member 200 secured to a guide rail 202, according to an embodiment of the present disclosure. In this embodiment, the adjustable support member 200 is adjustably secured directly to the guide rail 202. Unlike the embodiment shown in FIG. 1, no adjustable guide beam is positioned between the guide rail 202 and the adjustable support member 200. Instead, fasteners 204 may include shafts that are disposed through a longitudinal guide channel (hidden from view) formed through a guide track 206 of the guide rail 202. The fasteners 204 may be adjusted, such as through selective loosening and tightening, with respect to the guide rail 202 in order to adjust and secure the adjustable support member 200 with respect to the guide rail 202. A mounting plate or base may be similarly adjustably secured to mounting beams, for example. The interface between the adjustable support member 200 and the guide rail 202 shown and described with respect to FIG. 9 may be used in place of any of the adjustable support members described above with respect to the assemblies, such as the assemblies 30 and 100.

Figure 10:
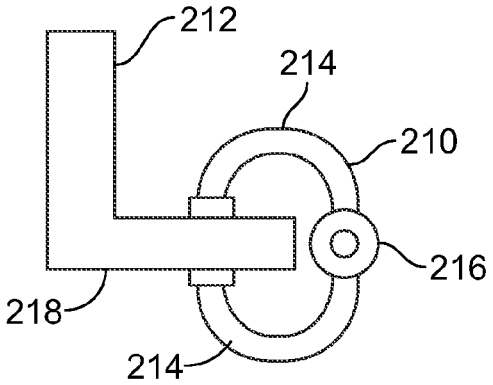
FIG. 10 illustrates an end view of a securing member secured to a guide rail, according to an embodiment of the present disclosure.

FIG. 10 illustrates an end view of a securing member 210 secured to a guide rail 212, according to an embodiment of the present disclosure. Instead of fasteners, such as bolts, screws, nuts, and the like, the securing member 210 may be an adjustable clamp having clamping arms 214 pivotally connected to a central spring-biased joint 216, for example. The clamping arms 214 may compressively clamp to a guide track 218 in the closed position. The securing member 210 may be connected to a portion of an adjustable equipment mount assembly, as described above. In order to adjust the adjustable equipment mount assembly with respect to the guide rail 212, the spring-biased joint 216 may be engaged to open the clamping arms 214 to disengage from the guide track 218. When a desired location is reached, the spring-biased joint 216 may be closed so that the guide track 218 is compressively sandwiched between the opposed clamping arms 214.

The securing member 210 may be used in place of any of the securing members, such as bolts, nuts, or the like, shown with respect to FIGS. 2-5, for example. The securing member 210 may be used with respect to the guide rails 38 as shown in FIG. 1, for example, as well as the adjustable guide beam 52 as also shown in FIG. 1.

Figure 11:
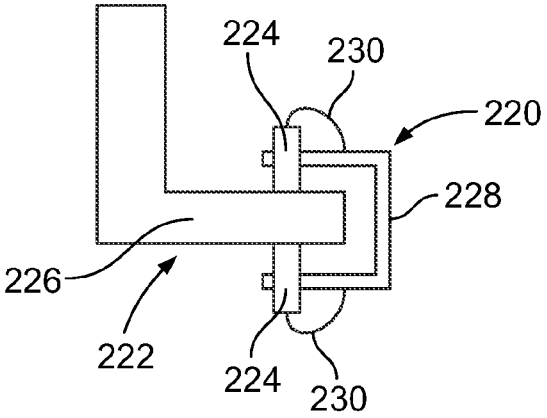
FIG. 11 illustrates an end view of a securing member secured to a guide rail, according to an embodiment of the present disclosure.

FIG. 11 illustrates an end view of a securing member 220 secured to a guide rail 222, according to an embodiment of the present disclosure. Instead of fasteners, such as bolts, screws, nuts, and the like, the securing member 220 may be used with respect to any of the embodiments described above. The securing member 220 may include rotatable wheels 224 above and below a guide track 226. The guide track 226 is sandwiched between the wheels 224. The wheels 224 are joined by a coupling member 228, such as a connection joint having axles extending through the wheels 224. Brakes 230 extend from the coupling member 228 to the wheels 224. In the secured position, the brakes 230 engage the wheels 224 to prevent the wheels 224 from rolling with respect to the guide track 226. When the brakes 230 are disengaged, the wheels 224 may rotate with respect to the guide track 226, thereby allowing an adjustable equipment mount assembly, to which the securing member 220 is attached, to be adjusted with respect to the guide rail 222.

The securing member 220 may be used in place of any of the securing members, such as bolts, nuts, or the like, shown with respect to FIGS. 2-5, for example. The securing member 220 may be used with respect to the guide rails 38 as shown in FIG. 1, for example, as well as the adjustable guide member 52 as also shown in FIG. 1.

Various types of securing members may be used to adjustably secure the adjustable equipment mount assemblies described above to an overhead support module. The securing members may be fasteners, such as bolts, screws, nuts, and the like, clamps, wheel assemblies, or various other devices that allow for adjustable positioning. The securing members may be manually operated to adjust the adjustable equipment mount assemblies. Optionally, various securing members may be operatively connected to actuating devices, such as motors, in order to provide automatic adjustment.

Figure 12:
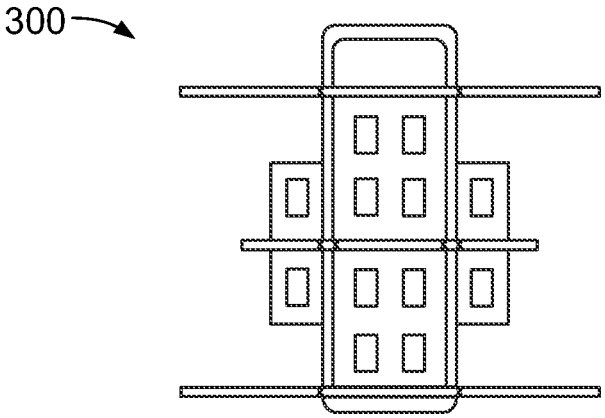
FIG. 12 illustrates a lateral view of equipment that may be secured to a securing plate of an adjustable equipment mount assembly, according to an embodiment of the present disclosure.

FIG. 12 illustrates a lateral view of equipment 300 that may be secured to a securing plate of an adjustable equipment mount assembly, as described above, according to an embodiment of the present disclosure. The equipment 300 may be a robotic operating assembly, a computer monitor, control panel, or the like.

Figure 13:
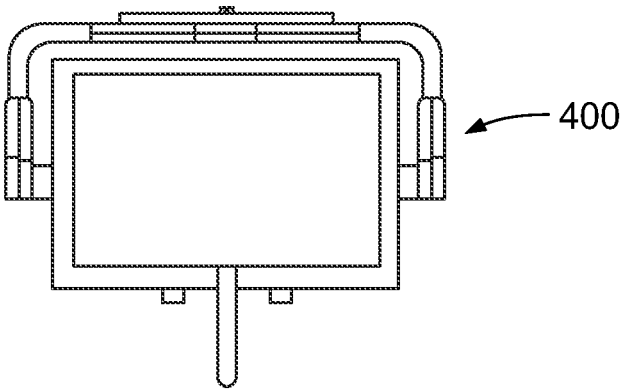
FIG. 13 illustrates a lateral view of equipment that may be secured to a securing plate of an adjustable equipment mount assembly, according to an embodiment of the present disclosure.

FIG. 13 illustrates a lateral view of equipment 400 that may be secured to a securing plate of an adjustable equipment mount assembly, as described above, according to an embodiment of the present disclosure. The equipment 400 may be a computer monitor, television, or the like.

Figure 14:
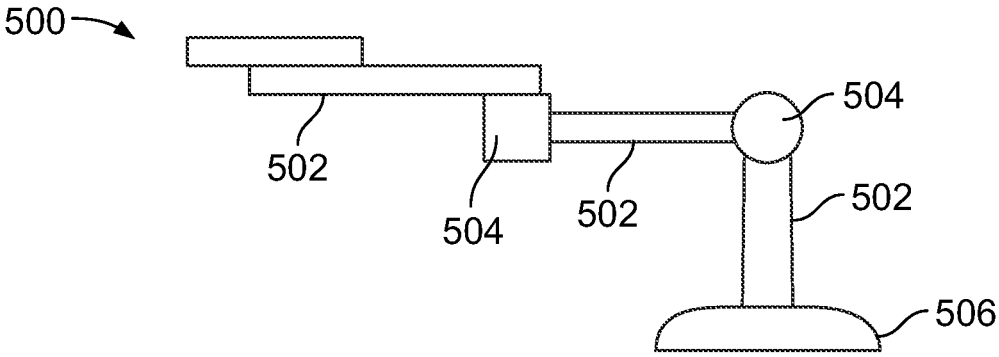
FIG. 14 illustrates a lateral view of equipment that may be secured to a securing plate of an adjustable equipment mount assembly, according to an embodiment of the present disclosure.

FIG. 14 illustrates a lateral view of equipment 500 that may be secured to a securing plate of an adjustable equipment mount assembly, according to an embodiment of the present disclosure. The equipment 500 may be a boom assembly having a plurality of arms 502 and articulating joints 504 that allow the boom assembly to be moved in various positions and orientations. Additional equipment 506, such as a light assembly, air delivery assembly, computer monitor, user interface, and/or the like, may be secured to a distal end of the boom assembly.

In general, the adjustable equipment mount assemblies described may be used with respect to various types of equipment, including light assemblies, robotic operating devices, control panels, monitors, surgical instruments and devices, imaging systems or devices, medical imaging systems or devices, or various other devices, structures, and the like.

Embodiments of the present application may be used with air handling systems and fan arrays. Air handling systems and fan arrays are further described and shown, for example, in U.S. Pat. No. 7,527,468, entitled "Fan Array Fan Section In Air-Handling Systems," U.S. Pat. No. 7,922,442, entitled "Fan Array Fan Section In Air Handling Systems," U.S. Pat. No. 7,914,252, entitled "Fan Array Fan Section In Air Handling Systems," U.S. Pat. No. 7,597,534, entitled "Fan Array Fan Section In Air Handling Systems," U.S. Pat. No. 8,087,877, entitled "Fan Array Fan Section In Air Handling Systems," U.S. Patent Application Publication No. 2011/0014061, entitled "Fan Array Control System," and U.S. Patent Application No. 2011/0255704, entitled "Methods and Systems for Active Sound Attenuation In An Air Handling Unit," all of which are hereby incorporated by reference in their entireties. Embodiments of the present disclosure may be used with various air handling or processing systems.

Embodiments of the present disclosure may be used with respect to an operating and/or clean room. Additionally, embodiments of the present disclosure may be used in various other settings. For example, the adjustable equipment mount assembly and overhead support module may be used with respect to data centers, such as shown and described in United States Patent Application Publication No. 2010/0051563, entitled "Modular Data Center," which is hereby incorporated by reference in its entirety. Additionally, the adjustable equipment mount assembly and overhead support module may be used in conjunction with fan array systems, such as shown and described in United States Patent Application Publication No. 2011/0014061, entitled "Fan Array Control System," which is hereby incorporated by reference in its entirety, and United States Patent Application Publication No. 2011/0255704, entitled "Methods and Systems for Active Sound Attenuation in an Air Handling Unit," which is also hereby incorporated by reference in its entirety.

Embodiments of the present disclosure provide adjustable equipment mount assemblies that may be adjusted with respect to an overhead support module in multiple directions. Thus, equipment that is hung from the assemblies is adjustable and adaptable to changing circumstances within a structure.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art.

Such other examples are intended to be within the scope of the claims if the examples have structural elements that do not differ from the literal language of the claims, or if the examples include equivalent structural elements with insubstantial differences from the literal languages of the claims.

What is claimed is:

1. An adjustable equipment mount assembly configured to be adjustably secured within an overhead support module that is configured to be secured to a structure and deliver air to the structure, the adjustable equipment mount assembly comprising:

an equipment mounting plate configured to connect to an equipment;

one or more first adjustable support members configured to allow the equipment mounting plate to be adjusted between different positions with respect to the overhead support module in a first direction, the one or more first adjustable support members comprising a translatable member, a guide track and a fastener extendable through the translatable member; and one or more second adjustable support members configured to allow the equipment mounting plate to be adjusted between different positions with respect to the overhead support module in a second direction that differs from the first direction, wherein the translatable member is configured to slidably translate in the first direction relative to the guide track when the fastener is in a loosened position, and the fastener is tightened to lock the translatable member at a desired position in the first direction.

2. The adjustable equipment mount assembly of claim 1, wherein the first direction is orthogonal to the second direction.

3. The adjustable equipment mount assembly of claim 1, further comprising an extension member extending from the equipment mounting plate, wherein the extension member comprises a securing plate configured to securely mount to the equipment.

4. The adjustable equipment mount assembly of claim 3, wherein the extension member is removably secured to the equipment mounting plate.

5. The adjustable equipment mount assembly of claim 3, wherein a height of the extension member is configured to be adjusted.

6. The adjustable equipment mount assembly of claim 1, further comprising one or more mounting beams connected to the equipment mounting plate and the one or more first adjustable support members.

7. The adjustable equipment mount assembly of claim 1, wherein the translatable member of the one or more first adjustable support member comprises a securing wall integrally connected to a ledge, and wherein the fastener is configured to be adjustably retained within the ledge.

8. An overhead support module configured to modularly secure to a structure, the overhead support module comprising:

outer walls defining an air delivery chamber configured to deliver air to the structure;

guide rails inwardly extending into the chamber from one or more of the outer walls, the guide rails comprising guide tracks; and an adjustable equipment mount assembly adjustably secured to internal portions of the outer walls within the chamber, the adjustable equipment mount assembly comprising:

an equipment mounting plate configured to connect to an equipment;

first adjustable support members adjustably secured to the guide tracks, wherein the first adjustable support members are configured to slidably translate with respect to the guide tracks to allow the equipment mounting plate to be adjusted with respect to the overhead support module in a first direction, the first adjustable support members comprising a fastener configured to be adjustably retained within the first adjustable support members to secure the first adjustable support members to the guide tracks at a particular position in the first direction; and second adjustable support members adjustably secured with respect to the equipment mounting plate, wherein the second adjustable support members are configured to be configured to be adjusted with respect to the equipment mounting plate to allow the equipment mounting plate to be adjusted with respect to the overhead support module in a second direction that differs from the first direction.

9. The overhead support module of claim 8, wherein the first direction is orthogonal to the second direction.

10. The overhead support module of claim 8, further comprising an extension member extending from the equipment mounting plate, wherein the extension member comprises a securing plate configured to securely mount to the equipment.

11. The overhead support module of claim 10, wherein the extension member is removably secured to the equipment mounting plate.

12. The overhead support module of claim 10, wherein a height of the extension member is configured to be adjusted.

13. The overhead support module of claim 8, wherein the adjustable equipment mount assembly further comprises one or more mounting beams connected to the equipment mounting plate and the first adjustable support members.

14. The overhead support module of claim 8, wherein the first adjustable support members comprises a securing wall integrally connected to a ledge, and wherein the fastener is configured to be adjustably retained within the ledge.

15. An adjustable equipment mount assembly configured to be adjustably secured within an overhead support module that is configured to be secured to a structure, wherein the overhead support module is configured to deliver air to the structure, the adjustable equipment mount assembly comprising:

an equipment mounting plate configured to connect to an equipment;

an extension member extending from the equipment mounting plate, wherein the extension member comprises a securing plate configured to securely mount to the equipment;

one or more first adjustable support members configured to allow the equipment mounting plate to be adjusted between different positions with respect to the overhead support module in a first direction; and one or more second adjustable support members configured to allow the equipment mounting plate to be adjusted between different positions with respect to the overhead support module in a second direction that differs from the first direction.

16. The adjustable equipment mount assembly of claim 15, wherein the extension member is removably secured to the equipment mounting plate.

17. The adjustable equipment mount assembly of claim 15, wherein a height of the extension member is configured to be adjusted.

18. An adjustable equipment mount assembly configured to be adjustably secured within an overhead support module that is configured to be secured to a structure, wherein the overhead support module is configured to deliver air to the structure, the adjustable equipment mount assembly comprising:

an equipment mounting plate configured to connect to an equipment;

one or more first adjustable support members configured to allow the equipment mounting plate to be adjusted between different positions with respect to the overhead support module in a first direction;

one or more second adjustable support members configured to allow the equipment mounting plate to be adjusted between different positions with respect to the overhead support module in a second direction that differs from the first direction; and one or more mounting beams connected to the equipment mounting plate and the one or more first adjustable support members.

19. An overhead support module configured to modularly secure to a structure, the overhead support module comprising:

outer walls defining an air delivery chamber configured to deliver air to the structure;

guide rails inwardly extending into the chamber from one or more of the outer walls; and an adjustable equipment mount assembly adjustably secured to internal portions of the outer walls within the chamber, the adjustable equipment mount assembly comprising:

an equipment mounting plate configured to connect to an equipment;

an extension member extending from the equipment mounting plate, the extension member comprising a securing plate configured to securely mount to the equipment first adjustable support members adjustably secured to the guide rails, wherein the first adjustable support members are configured to be adjusted with respect to the guide rails to allow the equipment mounting plate to be adjusted with respect to the overhead support module in a first direction; and second adjustable support members adjustably secured with respect to the equipment mounting plate, wherein the second adjustable support members are configured to be configured to be adjusted with respect to the equipment mounting plate to allow the equipment mounting plate to be adjusted with respect to the overhead support module in a second direction that differs from the first direction.

20. The overhead support module of claim 19, wherein the extension member is removably secured to the equipment mounting plate.

21. The overhead support module of claim 19, wherein a height of the extension member is configured to be adjusted.

* * * * *